US008821192B2

(12) United States Patent
Chang et al.

(10) Patent No.: US 8,821,192 B2
(45) Date of Patent: Sep. 2, 2014

(54) ELECTRICAL CONNECTOR HAVE A GROUNDING TERMINAL WITH A TONGUE FOR IMPROVING MECHANICAL STABILITY

(71) Applicant: Hon Hai Precision Industry Co., Ltd., New Taipei (TW)

(72) Inventors: Yen-Chih Chang, New Taipei (TW); Ke-Hao Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/845,135

(22) Filed: Mar. 18, 2013

(65) Prior Publication Data

US 2013/0267124 A1 Oct. 10, 2013

(30) Foreign Application Priority Data

Apr. 9, 2012 (TW) ..... 101112390

(51) Int. Cl.
*H01R 24/00* (2011.01)

(52) U.S. Cl.
USPC ..... 439/630

(58) Field of Classification Search
CPC .. H01R 12/52; H01R 13/648; H01R 13/6586; H01R 13/65802; H01R 23/6873
USPC ..... 439/607.01, 66, 108, 83, 342, 857, 856, 439/626, 630
See application file for complete search history.

(56) References Cited

U.S. PATENT DOCUMENTS

| | | | | |
|---|---|---|---|---|
| 4,902,235 | A * | 2/1990 | Tonooka | 439/72 |
| 8,668,500 | B2 * | 3/2014 | Kobayashi | 439/66 |
| 2001/0002343 | A1 * | 5/2001 | Suzuki | 439/101 |
| 2012/0196481 | A1 * | 8/2012 | Ju | 439/626 |
| 2012/0238137 | A1 * | 9/2012 | Cai | 439/607.28 |
| 2013/0095698 | A1 * | 4/2013 | Ju et al. | 439/626 |

FOREIGN PATENT DOCUMENTS

TW M253977 12/2004

* cited by examiner

*Primary Examiner* — Edwin A. Leon
(74) *Attorney, Agent, or Firm* — Wei Te Chung; Ming Chieh Chang

(57) ABSTRACT

An electrical connector electrically connecting a chip module to a printed circuit board includes an insulative housing that a number of contacting terminals and a number of grounding terminals received therein, the insulative housing includes a mating surface and a mounting surface opposite to the mating surface, the grounding terminal is adjacent to the contacting terminal, and wherein the insulative housing also comprises a plurality of retention slots depressed from the matching surface thereof for fixing a retention portion of the grounding terminals, the retention slot has a sidewall that plated with a metal layer, the retention portion comprises a tongue and elastic contacted with the metal layer.

16 Claims, 5 Drawing Sheets

ELECTRICAL CONNECTOR HAVE A GROUNDING TERMINAL WITH A TONGUE FOR IMPROVING MECHANICAL STABILITY

FIELD OF THE INVENTION

The present invention relates to an electrical connector, and more particularly to an electrical connector has a grounding terminal with a tongue for improving mechanical stability between the grounding terminal and the insulative housing.

DESCRIPTION OF THE PRIOR ART

As the recent technology show, a number of electrical connectors have to set a grounding device due to high transmitting speed and high frequency. The transmitting speed becomes faster and faster, the influence of the interference becomes larger and larger. The electrical connector not only includes signal contacts, but also includes grounding contacts assembled around the signal contacts, so as to prevent the interference produced by the signal contact.

An electrical connector electrically connecting a chip module to a printed circuit board is described in Tai Wan Patent No. M253977, issued to MA etc. on Dec. 21, 2004. The electrical connector includes a socket body with a plurality of electrical contacts secured therein. The contact can move upwardly and downwardly relative to the socket body, so it may not contacts stably.

Therefore, it is needed to find a new electrical socket to overcome the problems mentioned above.

SUMMARY OF THE INVENTION

Accordingly, an object of the present invention is to provide an electrical connector electrically connecting stably.

In order to achieve the object set forth, an electrical connector electrically connecting a chip module to a printed circuit board includes an insulative housing that a number of contacting terminals and a number of grounding terminals received therein, the insulative housing includes a mating surface and a mounting surface opposite to the mating surface, the grounding terminal is adjacent to the contacting terminal, and wherein the insulative housing also comprises a plurality of retention slots depressed from the matching surface thereof for fixing a retention portion of the grounding terminals, the retention slot has a sidewall that plated with a metal layer, the retention portion comprises a tongue and elastic contacted with the metal layer.

DESCRIPTION OF PREFERRED EMBODIMENT

Reference will now be made to the drawings to describe the present invention in detail.

Figure 1:
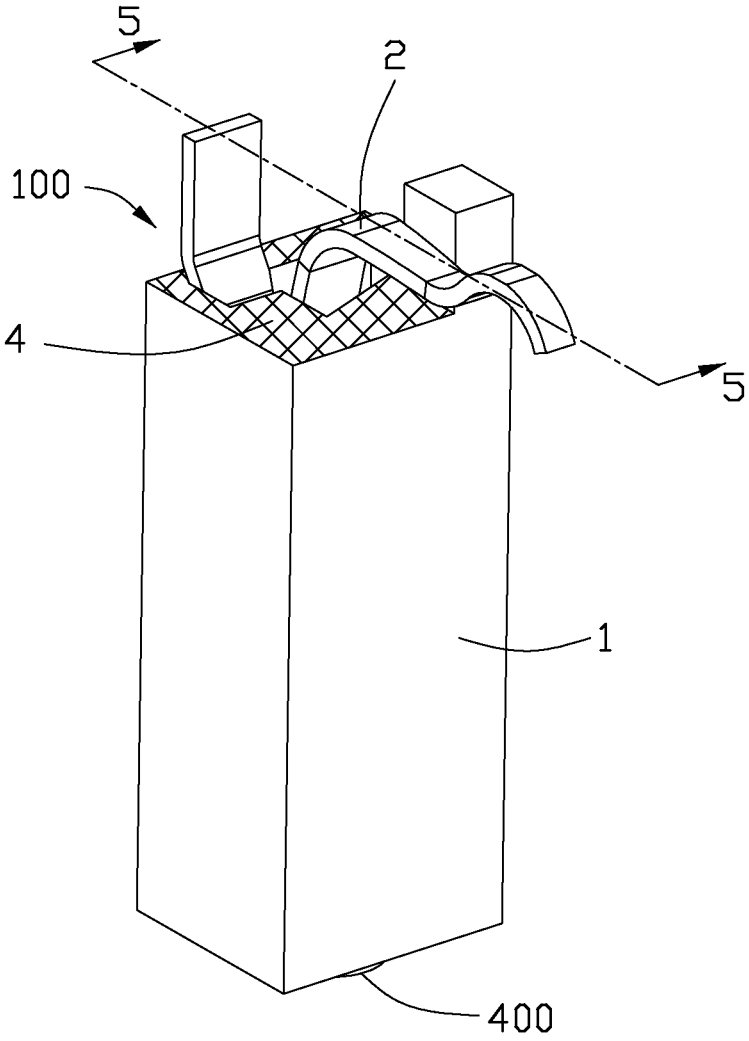
FIG. 1 is an isometric, assembled view of an electrical connector in accordance with a preferred embodiment of the present invention.
Figure 2:
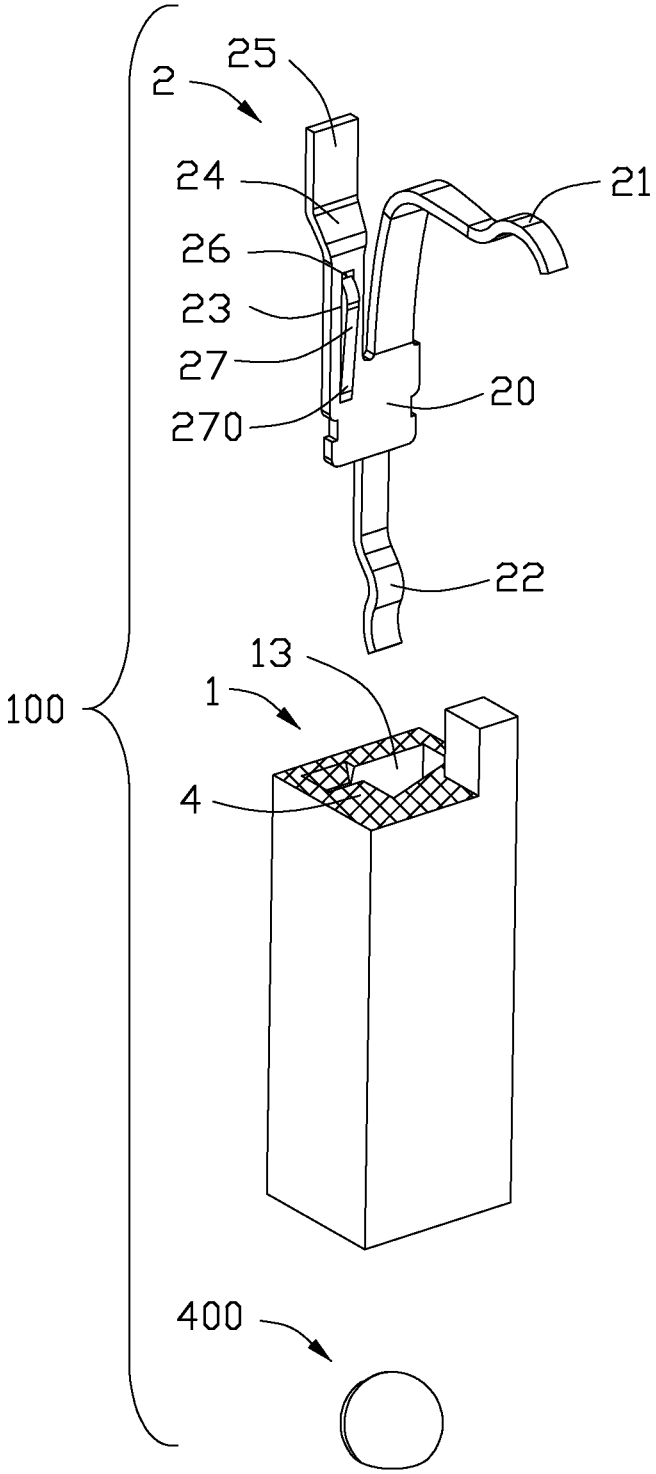
FIG. 2 is an isometric, exploded view of the electrical connector as shown in FIG. 1.

Referring to FIGS. 1-2, an electrical connector 100 according to the present invention is used to electrically connecting a chip module to a printed circuit board (not show) and comprises an insulative housing 1 with a plurality of contacting terminals (not show) received therein and a plurality of grounding terminals 2 received therein and a plurality of solder balls 400 soldered the grounding terminals 2 to the printed circuit board. The contacting terminal is adjacent to the grounding terminal 2.

Figure 3:
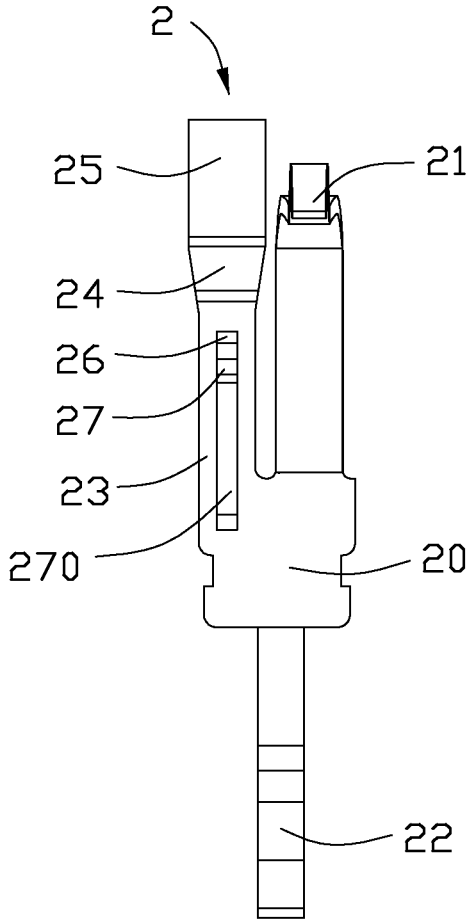
FIG. 3 is a side view of the grounding terminal as shown in FIG. 2.
Figure 4:
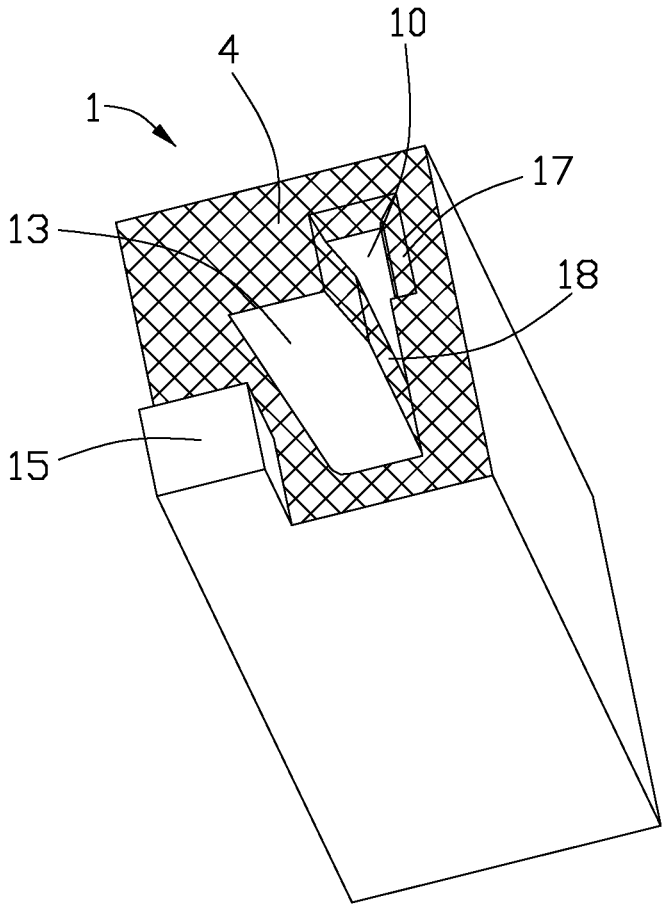
FIG. 4 is an isometric view of the insulative housing as shown in FIG. 1.
Figure 5:
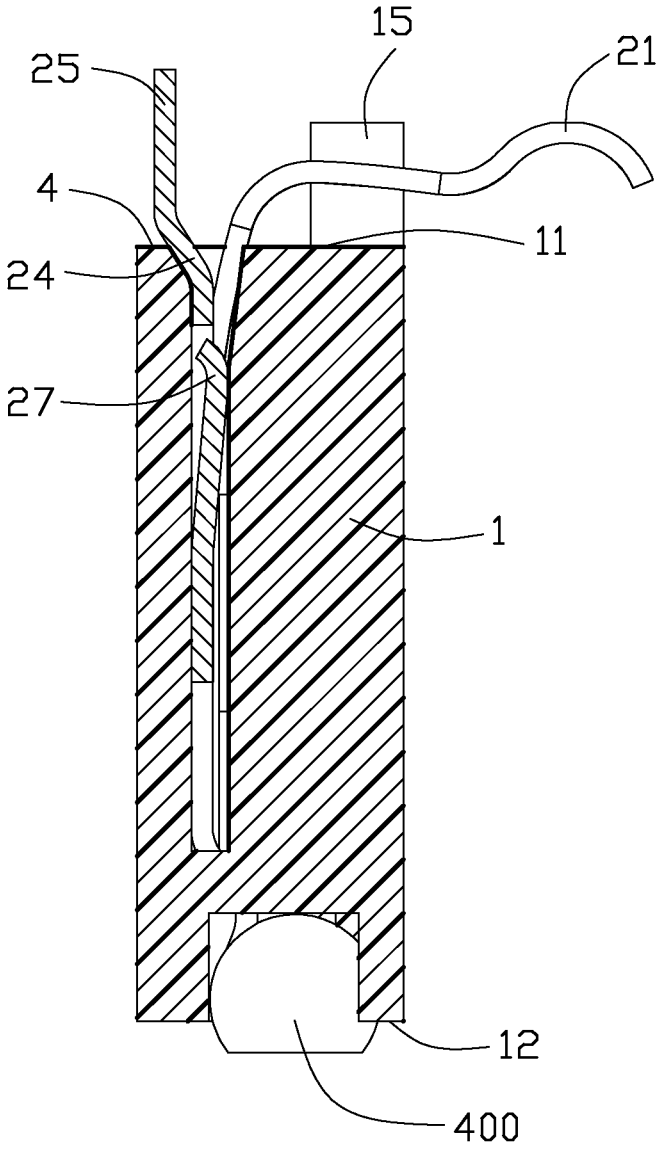
FIG. 5 is a cross-sectional view of the electrical connector taken along line 5-5 in FIG. 1.

Referring to FIGS. 3-5, the insulative housing 1 is made of insulating material, and comprises a matching surface 11 and a mounting surface 12 opposite to the matching surface 11. The insulative housing 1 also comprises a plurality of receiving passageway, a plurality of receiving slots 13 penetrated from the matching surface 11 to the mounting surface 12 and a plurality of retention slots 10 communicated with the receiving slots 13 respectively. The contacting terminal is received in the receiving passageway and the grounding terminal 2 is received in the receiving slot 13 and the retention slot 10. The opening of the receiving slot 13 is configured to a ladder-shape and the retention slot 10 is configured to a rectangle shape. The insulative housing 1 further comprises a recess (not labeled) depressed from the mounting surface 12 for receiving the solder ball 400. The retention slot 10 has a sidewall (not show), the sidewall and the matching surface 11 are plated with a metal layer 4 respectively. The retention slot 10 has a leading portion 17 slants inwardly from the matching surface 11. The retention slot 10 also has a contacting portion 18 located below the leading portion 17, the leading portion 17 and the contacting portion 18 are all plated with the metal layer 4. The insulative housing 1 also comprises a plurality of projections 15 protruding upwardly from the matching surface 11 and adjacent to the receiving slots 13 respectively. The projection 15 is used to prevent excessive deformation of the contacting terminals or the grounding terminals 2 due to the chip module presses the electrical connector 1 excessively.

Referring to FIGS. 2-3, each of the grounding terminals 2 comprises a base 20, a contacting portion 21 extending upwardly from the base 20 and projecting beyond the matching surface 11 and a soldering or tail portion 22 extending downwardly from the base 20. The grounding terminal 2 also comprises a supporting portion extending outwardly and upwardly from a side of the base 20. The supporting portion comprises a retention portion 23 connected with the base 20, a bending portion 24 bending upwardly from the retention portion 23 and an extending portion 25 extending upwardly from the bending portion 24. The retention portion 23 and the extending portion 25 both extend upwardly in a vertical direction. The width of the bending portion 24 is larger than that of the retention portion 23 and the width of the extending portion 25 is larger than that of the bending portion 24. The extending portion 25 is parallel to the retention portion 23 in the vertical direction. The retention portion 23 defines a slot 26 and a tongue 27 protruding from the slot 26. The tongue 27 has a bottom portion 270 connected with the bottom of the retention portion 23. The tongue 27 projects out of the surface of the retention portion 23 and the bending portion 24 bends opposite to the direction that the tongue 27 projects. Thus, the tongue 27 and the bending portion 24 are located at the two opposite sides of the retention portion 23.

Referring to FIGS. 1-4, when assembling the grounding terminals 2 to the insulative housing 1, the bending portion 24 pushes the leading portion 17 and contacts with the metal layer 4 that plated to the leading portion 17. The tongue 27 contacts with the metal layer 4 of the contacting portion 18, furthermore, the tongue 27 is elastic and interferes with the contacting portion 18 while the tongue 27 contacts with the metal layer 4. And then, after the grounding terminal 2 is received in the retention slot 10, the tongue 27 contacts with the metal layer 4 and the bending portion 24 contacts with the metal layer 4 at the same time, so, the grounding terminal 2 electrically connects the insulative housing 1 stably.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector electrically connecting a chip module to a printed circuit board comprising:

an insulative housing comprising a mating surface and a mounting surface opposite to the mating surface;

a plurality of contacting terminals received in the insulative housing; and a plurality of grounding terminals received in the insulative housing and adjacent to the contacting terminal; and wherein the insulative housing also comprises a plurality of retention slots depressed from the matching surface thereof for fixing a retention portion of the grounding terminals, the retention slot has a sidewall that plated with a metal layer, and the retention portion comprises a tongue elastically contacting the metal layer; wherein said retention portion defines a slot and a tongue protruding from the slot.

2. The electrical connector as claimed in claim 1, wherein said grounding terminal comprises a bending portion bending upwardly from the retention portion and an extending portion extending upwardly from the bending portion, the tongue projects out of the surface of the retention portion and locates at one side of the retention portion.

3. The electrical connector as claimed in claim 2, wherein said bending portion bends opposite to the direction that the tongue projects.

4. The electrical connector as claimed in claim 2, wherein said retention slot has a leading portion slants inwardly from the matching surface, the bending portion pushes the leading portion and contacts with the metal layer that plated to the matching surface and the leading portion.

5. The electrical connector as claimed in claim 2, wherein the width of the bending portion is larger than the width of the retention portion.

6. The electrical connector as claimed in claim 5, wherein the width of the extending portion is larger than the width of the bending portion.

7. The electrical connector as claimed in claim 1, wherein said grounding terminal comprises a base, a contacting portion extending upwardly from the base and projecting upon the matching surface and a soldering portion extending downwardly from the base and the retention portion extending outwardly and upwardly from a side of the base.

8. The electrical connector as claimed in claim 7, wherein said insulative housing comprises a receiving slot communicated with the retention slot and the grounding terminal is received in the receiving slot and the retention slot, the electrical connector also comprises a plurality of solder balls used for soldering the grounding terminals to the printed circuit board.

9. An electrical connector comprising:

an insulative housing with a contacting terminal therein and defining a retention slot and forming a plurality of sidewalls surrounding with the retention slot; and a grounding terminal received in the retention slot of the insulative housing and comprising a retention portion, a contacting portion extending outwardly of the insulative housing; and wherein at least one of the sidewalls of the insulative housing is plated with a metal layer, the retention portion defines a pair of side faces and a tongue protrudes out of one side face, so the tongue or another side face of the retention portion contacts with the metal layer of the sidewall of the insulative wherein said retention portion further comprises a slot and the tongue protrudes from the slot.

10. The electrical connector as claimed in claim 9, wherein said grounding terminal further comprises a base, a soldering portion extending downwardly from the base, the retention portion extends outwardly and upwardly from one side of the base and connects with the base, the contacting portion extends upwardly from the base.

11. The electrical connector as claimed in claim 9, wherein said grounding terminal also comprises a bending portion bending upwardly from one side of the retention portion and an extending portion extending upwardly from the bending portion, the bending portion and the tongue is located at opposite sides of the retention portion.

12. The electrical connector as claimed in claim 9, wherein said insulative housing comprises a receiving slot communicated with the retention slot and the grounding terminal is also received in the receiving slot, the electrical connector also comprises a plurality of solder balls used for soldering the grounding terminals to the printed circuit board.

13. An electrical connector comprising:

an insulative housing defining opposite upper and bottom surfaces in a vertical direction;

at least one slot formed in the housing and extending through both said upper and bottom surfaces;

a metallic layer applied on an interior surface of the slot and continuously at least on one of said upper and bottom surfaces around said slot; and a grounding terminal disposed in the slot, said grounding terminal defining an upper mating contacting section extending above the upper surface, and a tail section located around the bottom surface; wherein said grounding terminal defines a portion mechanically and electrically connecting to the metallic layer on the interior surface of the slot; said portion is a part of a retention section of said grounding terminal, which is located beside the contacting section; said grounding terminal includes an extending portion unitarily upwardly extending from said retention section and beyond the upper surface.

14. The electrical connector as claimed in claim 13, wherein said portion is elastic.

15. The electrical connector as claimed in claim 13, wherein said grounding terminal defines a base, from which both said retention section and said contacting section extend upward and said tail section extends downward.

16. The electrical connector as claimed in claim 13, wherein said upper surface is equipped with a standoff beside said contacting section.

* * * * *